United States Patent [19]

Sommers et al.

[11] Patent Number: 4,702,690

[45] Date of Patent: Oct. 27, 1987

[54] ULTRA-MINIATURE COLLAPSIBLE BUTANE FUELED MANTLE LANTERN

[76] Inventors: Dale C. Sommers, 3013 S. Ogden St., Englewood, Colo. 80110; Frank L. Hibberd; Doreen M. Jayko, both of 1525 Cleveland Pl., Denver, Colo. 80202

[21] Appl. No.: 887,534

[22] Filed: Jul. 21, 1986

[51] Int. Cl.[4] ..... F21H 7/00

[52] U.S. Cl. ..... 131/110; 431/111; 431/253; 431/256; 126/255; 362/179

[58] Field of Search ..... 126/44, 47, 48, 97, 126/255; 431/100, 102–106, 110, 111, 112, 113, 253, 256, 291; 362/179

[56] References Cited

U.S. PATENT DOCUMENTS

| | | | |
|---|---|---|---|
| 3,817,684 | 6/1974 | Sell | 431/104 |
| 4,089,635 | 5/1978 | Sivignon | 431/111 |
| 4,205,288 | 5/1977 | Plozner | 431/110 X |

*Primary Examiner*—Margaret A. Focarino

[57] ABSTRACT

Disclosed is an improved, ultra-compact, piezoelectric spark start, butane fueled, incandescent mantle type lantern for backpackers and the like, which utilizes readily available, common disposable butane cigarette lighters as an insertable and removable "fuel cell". Illumination intensity is operator controlled at the fuel cell flame adjustment control. Piezo sparking is sequenced with push-button movement of the butane lighter gas release lever, for convenient and controlled gas discharge. The lantern base portion is retractable on upright posts, into the globe (upper assembly) once the "fuel cell" is removed from the base guide, and the combination piezoelectric element and fuel cell receiver. Once removed from the receiver integral to the lantern, the "fuel cell" again may be used as a conventional cigarette lighter. A perforated, sleeve-type, sliding cylindrical shroud is located at the top of the present design, and is moveable vertically, so as to protect the globe during transport, and a wire handle is located thereupon, which folds under the base of the lantern in the collapsed mode, for convenient packaging and transport.

1 Claim, 6 Drawing Figures

ULTRA-MINIATURE COLLAPSIBLE BUTANE FUELED MANTLE LANTERN

BACKGROUND OF THE INVENTION

The present invention relates to a collapsible, butane fueled, miniaturized, incandescent mantle-type gas lantern, which utilizes common disposable or refillable butane cigarette lighters as a removeable "fuel cell". In recent years, much attention has been given to downscaling and lightening of weight of various outdoors products. This attention has spawned several miniaturized lanterns and other specialized products, to serve the needs of the outdoors enthusiast. To this end, designers have developed lantern products which use readily available (proprietary or non-proprietary) fuel to gas the incandescent mantle. In the mountain climbing or backpacking field, lightness of weight is critical, and space available in a backpack is at a premium, so designers have produced several small lanterns to address these needs, particualrly those as now being manufactured by the COLEMAN CO., INC. (the PEAK I); HANK ROBERTS INC's Lantern and Stove Combination; CAMPING GAZ INTERNATIONAL's Lampe GT Lantern, and others, as found in U.S. Pat. No. 4,089,635, issued to Pierre Sivignon of France, (Now being manufactured as the Lampe GT); in U.S. Pat. No. 3,745,328, issued to Coler S. Hissem of Kansas; in U.S. Pat. No. 3,131,872, issued to Walter Harold Hoenisch of Michigan (assigned to KingSeeley Thermos Co.), and solid-fueled lanterns illuminated by a singular internal candle or other solid fuel suorce, such as is found in U.S. Pat. No. 4,260,365, issued to David Bandel, for his solid fuel lamp.

The present invention is a novel approach to the provision of a miniaturized incandescent mantle-type gas lamp, and is a collapsible, piezoelectric spark ignited, butane fueled, incandescent mantle lantern, which is ultra-compact, and which is fueled with a singular, removeable, common disposable butane cigarette lighter. Despite the various miniature lanterns which have recently been developed, there still exists a need for useful lamp technologies which address the weight, durability, and size demands of the outdoors enthusiast, and which are easily fueled, and are economical to maintain and operate. The present invention fills all the aforesaid needs, as it is similar in size and weight to the standard campers "Candle Lanterns" readily available in sporting goods stores throughout the nation, and provides the operator with several hours worth of light from a single disposable butane cigarette lighter.

SUMMARY OF THE INVENTION

It is an object of the present invention to provide an ultra-compact, incandescent mantle-type lamp which is vertically collapsible when the fuel cell is removed from it's assigned location. It is another object of the present invention to provide an ultra-compact backpack lamp which utilizes "as-is", readily available disposable or refillable butane cigarette lighters as a removeable "fuel cell". It is a further object of the present invention to provide for a fuel cell recieving mechanism and receptacle which provides for a sequenced activation of the cigarette lighter gas release valve lever, and activation of a piezoelectric spark ignitor, to provide convenient, one-touch operation and incandescent mantle activation. It is another object of the present invention to provide direct operational access to the "flame height adjustment gear" located upon the butane cigarette lighter, to assist in providing incandescent mantle illumination intensity adjustments. It is yet a further object of the present invention to provide a miniaturized lantern design which utilizes readily available incandescent lantern mantles and materials. It is another object of the present invention to provide for a reciever which readily and easily recieves a disposable or refillable butane cigarette lighter, for the purpose of controlled butane gas discharge from the lighter, and which reciever holds the lighter's jetted end securely, and which allows for no leakage of flammable gas. This reciever is connected securely to a vertical standpipe and incandescent mantle assembly, for purposes of incandescent mantle illumination.

It is a further object of the present invention to provide for a miniaturized incandescent mantle lantern which is fitted with a sleeve-type perforated shroud which snugly fits around the pyrex globe of the lamp, and which shroud is vertically moveable, so as to provide impact protection for the globe during transport, and illumination therethrough, as desired, and this shroud is fitted at the top edge of the shroud with a suitable handle for carrying and hanging the lamp, and the handle is of sufficient length so as to enable it to project below the base plate during the collapsed mode transport, and thereby hold the entire lamp assembly closed by tension.

BRIEF DRAWINGS DESCRIPTION

FIG. 1. is an isometric front view of the preferred embodiment, shown fully extended, with the fuel cell in place.

FIG. 2. is a base plan view of the present invention, with the fuel cell reciever door closed.

FIG. 3. is an elevational side view of the present invention, shown fully extended, with the fuel cell in place.

FIG. 4. is a top plan view of the preferred embodiment of the invention.

FIG. 5. is an elevational side view of the present invention, shown collapsed with fuel cell removed and adjacent to the base plate.

FIG. 6. is a side plan view of the preferred embodiment, in the collapsed mode, with the globe shroud lowered, and the handle brought inward, and under the base plate.

DETAILED DESCRIPTION OF THE PREFERRED EMBODIMENT

Figure 1:
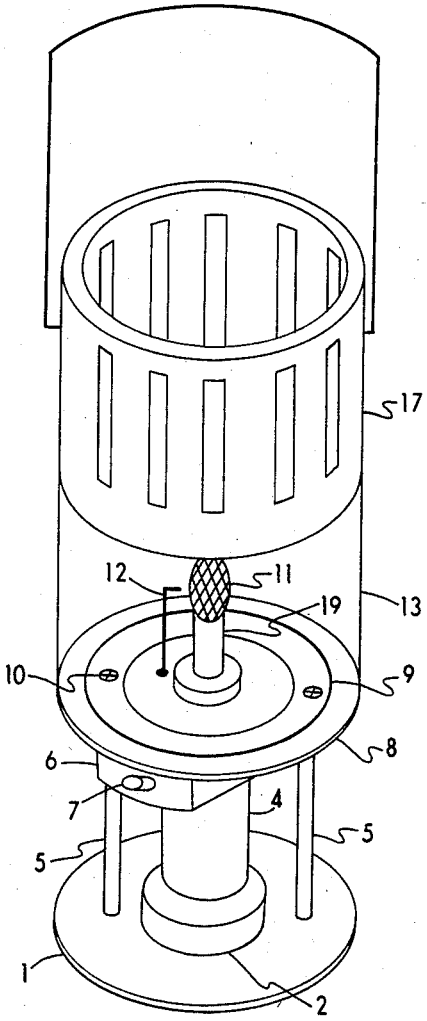
Figure 2:
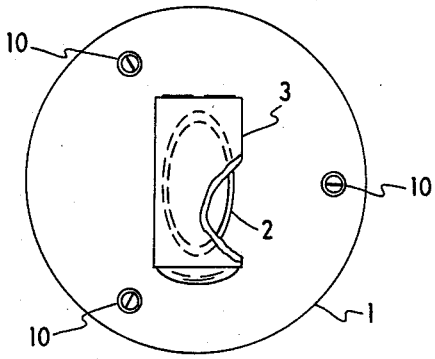
Figure 3:
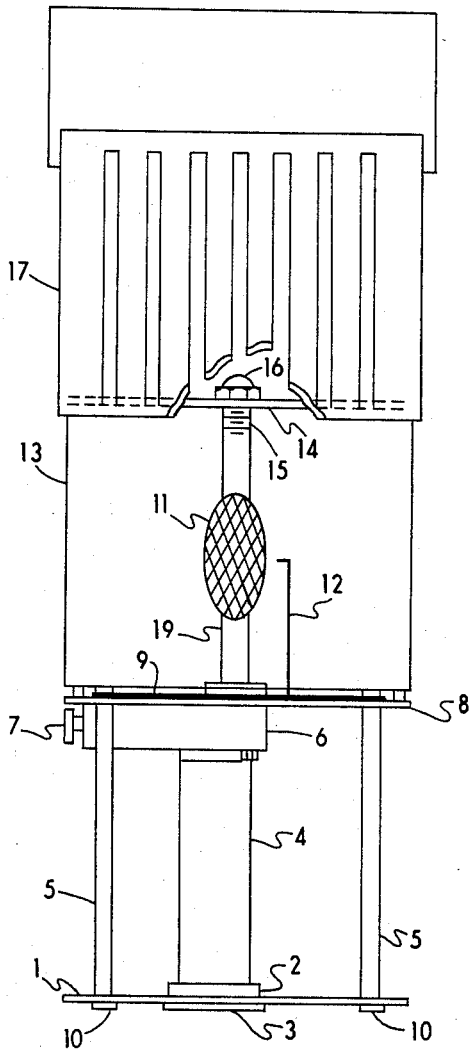

The present invention, in the preferred embodiment, comprises a collapsible, miniaturized, butane fueled, incandescent mantle-type gas lamp, provided with a globe protective shroud 17, and which utilizes disposable or refillable butane cigarette lighters as a removeable "fuel cell" 4, and is hereinafter disclosed and is best illustrated by the accompanying drawings FIGS. 1–6, herein forming a part of this specification. The structure and components comprising the present invention are as follows:

Lantern base plate 1 serves as a stable base platform for the appliance. Apeture and guide shoulder 2 serves as a close fitting guide to position the fuel cell 4 as it penetrates the base plate 1 and is subsequently pushed by the operator towards the fuel cell reciever 6. Latching door 3 hinges open to permit passage through apeture and guide 2 for the fuel cell 4, and the door 3 is provided on the end opposite the hinged end, with a latch, to allow the door 3 to be pushed upward and latched closed, to hold the fuel cell 4 in alignment and in engagement with the fuel cell reciever 6, and to allow vertical movement fixation thereby for the lantern upper assembly 18, and expansion of the collapsible design embodied by the present invention. Collapsibility in the preferred embodiment is preferrably obtained through the provision of three parallel upright posts 5, each individually fastened at 10 to the base plate 1, and at their opposite ends, to a yoke 9. The yoke 9 resides inside globe 13, and rests flat atop the fuel cell reciever mounting plate 8 (when the lamp is fully extended), and serves as a physical "stop" for the lamp upper assembly 18 during it's vertical movement and expansion after the fuel cell 4 insertion. Parallel upright posts 5 penetrate mated oversize holes through, provided in the fuel cell reciever mounting plate 8 thereby allowing for vertical movement of plate 8 and lantern upper assembly 18, relative to lantern base plate 1, as is illustrated by drawings FIGS. 1–6.

Figure 6:
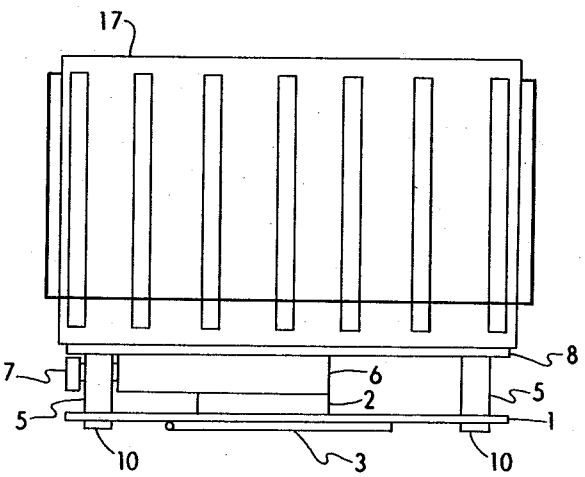
Figure 4:
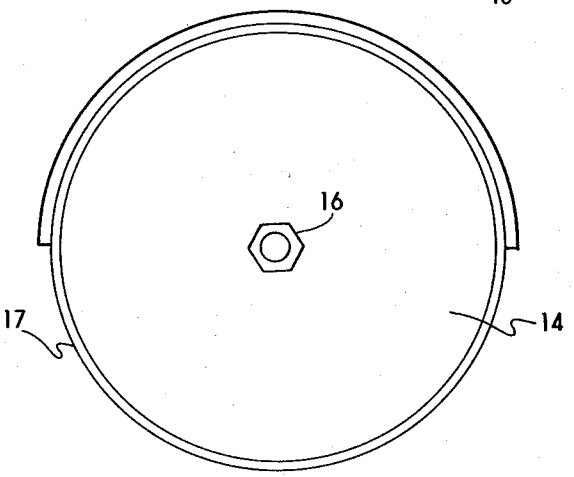
Figure 5:
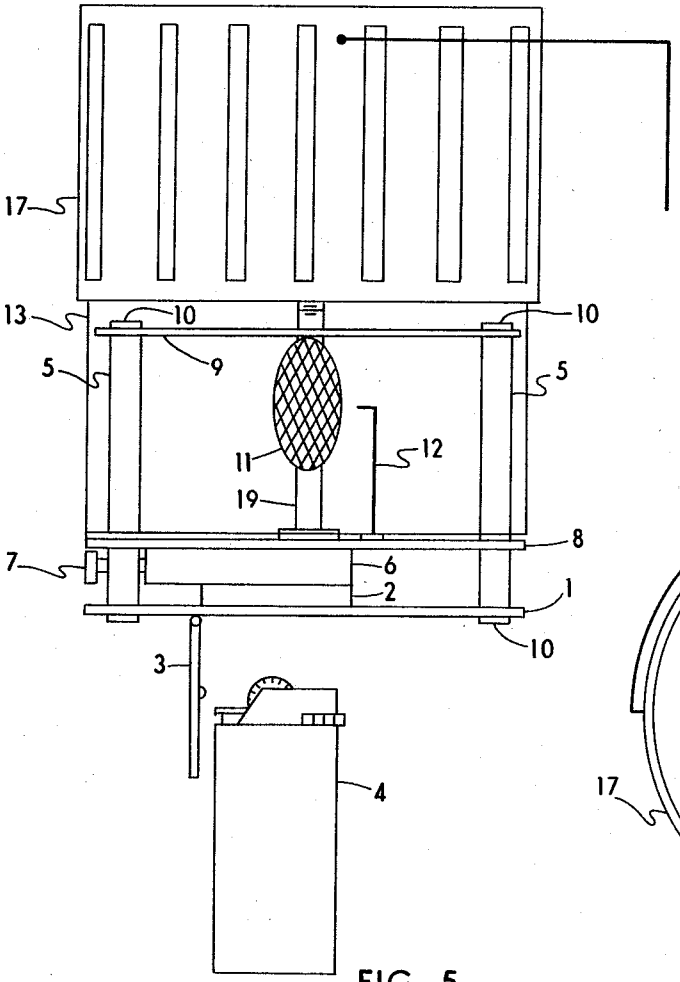

The present invention in the collapsed mode, is best illustrated by drawings FIGS. 5 & 6, in which the fuel cell 4 is depicted as having been removed from the fuel cell reciever 6, base plate 1 and guide shoulder 2, through open door 3, thereby collapsing the design embodying the present invention. As it is the fuel cell 4 then, when fully inserted, which holds the present invention in expansion, it is imperative that the latching means on door 3 be sufficiently strong to hold the fuel cell 4 uppermost in full engagement with the fuel cell reciever 6, and lowermost against base plate 1. Fuel cell reciever 6 mates with the upper portion of the fuel cell 4, thereby, and securely holds the fuel cell 4 in position, where butane fuel may be controllably discharged from the fuel cell 4. Pushbutton activator means 7 provides movement for piezoelectric sparking, and additionally depresses and holds fuel cell 4 gas release valve lever, operating in a sequential manner, to provide for satisfactory ignition of the incandescent mantle 11. Butane gas flow and mantle illumination intensity is thereafter user controlled by unobstructed fuel cell 4 flame height control gear, commonly located near the top of todays production disposable or refillable butane cigarette lighters.

Fuel cell reciever mounting plate 8 is keyed to the upper portion of the fuel cell reciever 6, and is centrally perforated to permit shouldered riser and incandescent mantle assembly 11 to communicate with the fuel cell receiver 6, and permit butane gas flow to the incandescent mantle. Riser assembly 19 fastens and holds securely plate 8, as riser assembly 19 is threaded into fuel cell reciever's 6 upper portion, providing for secure assembly. Preferrably, formed notches located near the periphery of plate 8 and on lantern top plate 14, serve as locators and combustion ventilation elevators for globe 13, to hold globe 13 apart from plate 8 and top plate 14. Spark gap 12 provides piezoelectric ignition discharge point for the butane gas, as available at the incandescent mantle 11. Spark gap 12 riser wire is directly connected to the discharge terminal of the piezoelectric element located within the fuel cell reciever 6. Riser assembly 19 is alternatively grounded to the piezoelectric element opposite terminal, to provide for an open-ended circuit necessary for spark gap 12 sparking activity.

Top plate 14 rests upon threaded stud 15 provided atop riser assembly 19, and preferrably (as found also on plate 8), formed notches located near the periphery of plate 14 index the upper portion and edge of globe 13, and help to provide adequate ventilation for combustion. Cap nut 16 affixes top plate 14 onto riser stud 15 securely. Perforated globe shroud sleeve and wire handle assembly 17 moveably surround top plate 14 and globe 13, and when lowered, serve to protect globe 13 during transport, and provides suitable means for carrying and hanging the lamp. The wire handle is foldable under base plate 1, when the lamp is in the collapsed mode, so as to secure the lamp assembly in a closed position for convenient packaging and transport. The bottom edge of shroud 17 is turned inwardly of shroud 17 perimeter so as to serve as a guide and stop for shroud's 17 downward travel ability. Top plate 14 serves as the stop point in conjunction with the aforesaid inwardly turned shroud 17 edge, for the shroud's upward travel ability, and the outside face of globe 13 and outer edge of top plate 14 serve as guides therefor. Perforations in the shroud 17 provide for illumination therethrough as desired, and ventilation. During transport of the lamp, the shroud 17 inwardly turned bottom edge rests upon the upper face of the fuel cell reciever mounting plate 8, and the shroud 17 upper edge and wire handle attached thereto, project somewhat above the top face of top plate 14 and cap nut 16, as illustrated in cutaway drawings FIG. 6.

Although the present invention has herein been described with particularity relative to the foregoing detailed description of the preferred embodiment, it is understood that this description of the disclosed invention is done to fully comply with the requirements of 35 USC Sec. 112, and is not intended to limit the invention in any way. Various modifications, changes, additions, and applications other than those specifically outlined herein will be readily apparent to those having ordinary skill in the art, without departing from the spirit and scope of my invention, and may be considered to be within the scope and essence of my invention. Accordingly, it is desired that the scope of my present invention be determined not entirely by the foregoing specification and the embodiments illustrated, but by the appended claims and thier legal equivalents.

What is claimed is:

1. An improved, portable, collapsible gas lamp of the type employing an incandescent mantle, structured with a removeable "fuel cell" as is embodied as a disposable or refillable butane, pocket size cigarette lighter; comprised of a fuel cell guide flange and shoulder, centrally located upon the uppermost face of a flat plate base plate; and a closure-fitted, hinged flap door, located upon the lowermost face of said flat base plate, provided in conjunction with said fuel cell guide flange; and a series of parallel, upright posts, which individually attach to, and vertically project from, the uppermost face of said base plate, and which are each individually attached to a flat plate yoke at said posts uppermost ends; and a cylindrical glass chimney, surrounding said incadescent mantle, which is supported by parallel second and third flat plate members, which individually and supportively reside above and below said glass chimney; and a flat plate yoke, residing atop said second flat plate member, and said yoke being contained inwardly within said glass chimney, and the uppermost ends of said parallel posts are attached to siad yoke; and a fuel cell receiver, sized to accomodate a pocket sized disposable cigarette lighter, which receiver is provided with a fuel cell gas outlet, and a fuel cell gas release valve lever depressor, and said receptacle is affixed upon the undermost face of said second flat plate member, and said receptacle internally contains a piezoelectric spark ignitor, which operates in conjunction with said fuel cell gas release valve lever depressor; and an incandescent mantle, mounted upon a vertical, perforated stand pipe, the base of said stand pipe is connected to the fuel cell receptacle gas outlet; and a, vertically moveable, cylindrical sleeve-type perforated metallic, glass chimney protective shroud, with a folding wire handle attached surrounding said third flat plate and said glass chimney.

* * * * *